US010372072B2

(12) United States Patent
Yamaki et al.

(10) Patent No.: US 10,372,072 B2
(45) Date of Patent: Aug. 6, 2019

(54) IMAGE FORMING APPARATUS, CONDUCTIVE MEMBER SERVICE LIFE DETERMINATION METHOD, AND CONDUCTIVE MEMBER SERVICE LIFE DETERMINATION PROGRAM

(71) Applicant: Konica Minolta, Inc., Chiyoda-ku, Tokyo (JP)

(72) Inventors: Hideo Yamaki, Hachioji (JP); Satoru Shibuya, Chiryu (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/635,604

(22) Filed: Jun. 28, 2017

(65) Prior Publication Data

US 2018/0004141 A1 Jan. 4, 2018

(30) Foreign Application Priority Data

Jun. 29, 2016 (JP) ..... 2016-129163

(51) Int. Cl.
*G03G 15/00* (2006.01)
*G03G 21/20* (2006.01)
(Continued)

(52) U.S. Cl.
CPC ..... *G03G 15/55* (2013.01); *G03G 15/0266* (2013.01); *G03G 15/065* (2013.01); *G03G 15/1675* (2013.01); *G03G 21/20* (2013.01)

(58) Field of Classification Search
CPC .. G03G 15/55; G03G 15/0266; G03G 15/065; G03G 15/1675; G03G 21/20
(Continued)

(56) References Cited

U.S. PATENT DOCUMENTS 6,473,572 B1 * 10/2002 Uchiyama ..... G03G 21/1889 399/24
8,326,164 B2 * 12/2012 Choi ..... G03G 15/0266 399/50
2014/0270819 A1 9/2014 Wada et al.

FOREIGN PATENT DOCUMENTS

EP 2667258 A1 * 11/2013 ..... C09D 175/04
EP 2728413 A2 5/2014
(Continued)

OTHER PUBLICATIONS

European Patent Application No. 17174856.9; Extended Search Report; dated Nov. 20, 2017; 9 pages.

*Primary Examiner* — Susan S Lee
(74) *Attorney, Agent, or Firm* — Baker Hostetler

(57) ABSTRACT

An image forming apparatus provided with a conductive member to form an image on a sheet using a toner includes: a voltage acquisition portion configured to acquire a biased voltage value as a voltage value by applying a bias to the conductive member; an environment sensor configured to output an environment condition measurement value representing an internal environment condition; and a hardware processor configured to transform the biased voltage value acquired by the voltage acquisition portion into a virtual voltage value appearing in the conductive member as the biased voltage value under a standard environment condition, in which the environment condition has a predetermined standard condition, on the basis of the environment condition measurement value output from the environment sensor, and determine a service life of the conductive member on the basis of the virtual voltage value.

21 Claims, 7 Drawing Sheets

(51) Int. Cl.
*G03G 15/02* (2006.01)
*G03G 15/06* (2006.01)
*G03G 15/16* (2006.01)

(58) Field of Classification Search
USPC ..... 399/26
See application file for complete search history.

(56) References Cited

FOREIGN PATENT DOCUMENTS

| | | | | |
|---|---|---|---|---|
| JP | 2001117367 | A | * | 4/2001 |
| JP | 2001154512 | A | * | 6/2001 |
| JP | 2003-195700 | | | 7/2003 |
| JP | 2003195700 | A | * | 7/2003 |

* cited by examiner

FIG. 8

| | | a | b | c |
|---|---|---|---|---|
| ENVIRONMENTAL STEP | 1 | 4 | −280 | 5244 |
| | 2 LL | 3.9 | −270 | 5045 |
| | 3 | 3.7 | −259 | 4848 |
| | 4 | 3.6 | −249 | 4650 |
| | 5 | 3.4 | −238 | 4451 |
| | 6 | 3.2 | −221 | 4131 |
| | 7 | 2.9 | −203 | 3811 |
| | 8 | 2.7 | −189 | 3551 |
| | 9 | 2.5 | −175 | 3292 |
| | 10 NN | 2.3 | −161 | 3033 |
| | 11 | 2 | −140 | 2650 |
| | 12 | 1.5 | −105 | 2024 |
| | 13 | 1 | −70 | 1397 |
| | 14 | 0.8 | −53 | 1076 |
| | 15 HH | 0.5 | −35 | 742 |
| | 16 | 0.3 | −18 | 406 |

IMAGE FORMING APPARATUS, CONDUCTIVE MEMBER SERVICE LIFE DETERMINATION METHOD, AND CONDUCTIVE MEMBER SERVICE LIFE DETERMINATION PROGRAM

This application claims priority under 35 U.S.C. § 119 to Japanese Patent Application No. 2016-129163 filed on Jun. 29, 2016, the entire disclosure, including description, claims, drawings, and abstract, of which is incorporated herein by reference.

BACKGROUND

Technical Field

The present invention relates to an image forming apparatus that forms an image using a toner. More specifically, the present invention relates to an image forming apparatus having a conductive member used for image formation in an image forming portion, in which an increase of resistance accompanied by wear-out of the conductive member brings an end of a service life of the conductive member. In addition, the present invention also relates to a conductive member service life determination method for the image forming apparatus and a conductive member service life determination program executed by a computer that controls the image forming apparatus.

Description of the Related Art

In the related art, a conductive member is used for various purposes in an image forming portion of an image forming apparatus that forms an image using a toner. For example, the conductive member includes a charging roller, a transfer roller, a developing roller, and the like. Typically, a resistance of such a conductive member tends to increase as it is worn out. As the resistance of the conductive member increases, image quality is degraded, and finally, the conductive member encounters its service limitation. The conductive member encountering the service limitation is to be replaced with a new product. For this reason, some techniques have been proposed in the art to recognize the service limitation in advance.

JP 2003-195700 A discusses such a technique by way of example. In the technique of JP 2003-195700 A, a service life of the transfer roller is determined using a service life determination program on the basis of a voltage value for flowing a predetermined current through the transfer roller and a condition such as temperature and humidity at that timing. In this service life determination program, a service life table is used, in which the service lives and the voltage values to be determined are set for each environment condition. The service life is determined by mapping the measured voltage value of the transfer roller to a voltage value defined for the temperature and humidity of that timing in the service life table.

However, the technique of the related art described above has the following problems. In some cases, service life detection accuracy is unsatisfactory because of a characteristic of the voltage value exhibited by the conductive member. A general characteristic of the voltage value exhibited by the conductive member against the environment condition is shown in a graph of FIG. 1. As illustrated in FIG. 1, assuming that the abscissa refers to the environment condition (such as temperature or humidity), and the ordinate refers to the voltage value, the graph representing a relationship between the environment condition and the voltage value has a hyperbolic curve shape. Here, in FIG. 1, considering a variation of the detected voltage value, a lower limit voltage value is indicated by the solid line, and an upper limit voltage value is indicated by the dotted line. The dotted line curve of FIG. 1 may be considered as upward parallel translation of the solid line curve.

From the characteristic of the graph of FIG. 1, it is difficult to anticipate accuracy in the voltage value measured under a momentarily changing environment condition because the solid line curve or the dotted line curve has a steep slope in a low-temperature low-humidity side. For this reason, a slight fluctuation of the temperature/humidity ("X" in FIG. 1) generates a large variation of the voltage value (detection variation in the "low-temperature low-humidity side" in FIG. 1). Meanwhile, in the high-temperature high-humidity side, the slope of the curve is gentle, but the measured voltage value itself is small. For this reason, a gap between the solid line curve and the dotted line curve works significant as a variation of the voltage value. For this reason, the measured voltage value itself becomes irregular ("detection variation in high-temperature high-humidity side" in FIG. 1).

Nevertheless, if the environment condition keeps changing in the neutral-temperature neutral-humidity (NN) state for a long time, the detected voltage value gently increases as illustrated in FIG. 2. For this reason, a normal service life can be generally detected by setting a normal range for an approximation against a change of the detected voltage value (oblique bold line rising to the right side in FIG. 2) to about ±10%. When the detected voltage value reaches the "NN" threshold (horizontal bold line in FIG. 2), it may be determined that the service life is terminated. Although an abnormal value may occur from time to time, it is within a negligible range. Note that the "NN" threshold value refers to a voltage value specified for the neutral-temperature neutral-humidity condition in the aforementioned service life table.

However, in reality, a change of the environment condition is rarely maintained in the neutral-temperature neutral-humidity state for a long time. Actually, by all means, the environment condition unexpectedly changes as illustrated in FIG. 3. For this reason, while the detected voltage value is low under the high-temperature high-humidity (HH) condition, the detected voltage value is high under the low-temperature low-humidity (LL) condition as described above. Therefore, the detected voltage value is seriously fluctuated. Naturally, the determination threshold value itself is low under the high-temperature high-humidity condition (HH threshold value), and the determination threshold value itself is high under the low-temperature low-humidity condition (LL threshold value). However, under such a circumstance, reliability of the service life determination is inevitably low. This is because the detected voltage value itself has low accuracy under the high-temperature high-humidity condition or under the low-temperature low-humidity condition as described above. For this reason, a replacement timing of the conductive member may be delayed or expedited in some cases.

SUMMARY

The present invention has been made to address the aforementioned problems of the related art. That is, an object of the present invention is to provide an image forming apparatus capable of detecting a service life of the conductive member with high accuracy regardless of an environmental factor. In addition, another object of the present invention is to provide a conductive member service life determination method for the image forming apparatus and a conductive member service life determination program executed by a computer that controls the image forming apparatus.

To achieve at least one of the abovementioned objects, according to an aspect, an image forming apparatus provided with a conductive member to form an image on a sheet using a toner, reflecting one aspect of the present invention comprises: a voltage acquisition portion configured to acquire a biased voltage value as a voltage value by applying a bias to the conductive member; an environment sensor configured to output an environment condition measurement value representing an internal environment condition; and a hardware processor configured to transform the biased voltage value acquired by the voltage acquisition portion into a virtual voltage value appearing in the conductive member as the biased voltage value under a standard environment condition, in which the environment condition has a predetermined standard condition, on the basis of the environment condition measurement value output from the environment sensor, and determine a service life of the conductive member on the basis of the virtual voltage value.

BRIEF DESCRIPTION OF THE DRAWINGS

The above and other objects, advantages and features provided by one or more embodiments of the invention will become more fully understood from the detailed description given hereinbelow and the appended drawings which are given by way of illustration only, and thus are not intended as a definition of the limits of the present invention, and wherein:

FIG. 8 is a table showing coefficients of an approximation for each absolute humidity.

DETAILED DESCRIPTION OF EMBODIMENTS

Figure 1:
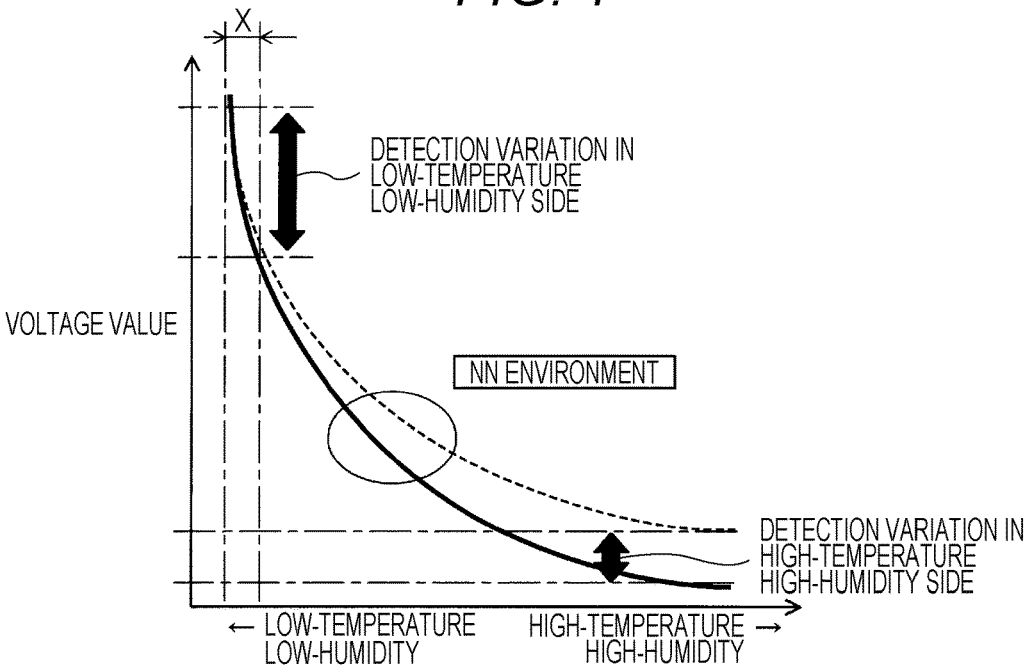
FIG. 1 is a graph illustrating a relationship between a voltage value of a conductive member and an environmental value.

Hereinafter, one or more embodiments of the present invention will be described in detail with reference to the drawings. However, the scope of the invention is not limited to the illustrated examples. The embodiments are obtained by applying the present invention to the image forming apparatus 1 of FIG. 4. The image forming apparatus 1 of FIG. 4 has an image forming portion 2 and a paper feeder 3. The image forming portion 2 according to an embodiment of the present invention is a tandem double-transfer type having four image forming units 4, an intermediate transfer belt 5, and a secondary transfer roller 6. The four image forming units 4 correspond to four colors including yellow, magenta, cyan, and black, and each image forming unit 4 has a photosensitive body 7, a charging roller 8, an exposure device 9, a developer 10, a primary transfer roller 11, and a cleaner 12. The developer 10 has a developing roller 13. The image forming portion 2 is further provided with a fixing device 14. As a result, a toner image is transferred onto a sheet supplied from the paper feeder 3 using the image forming portion 2, and the toner image is fixed using the fixing device 14.

In the image forming apparatus 1 according to this embodiment, the secondary transfer roller 6, the charging roller 8, the primary transfer roller 11, and the developing roller 13 are conductive members having resistance increasing along with wear-out. In the image forming apparatus 1 according to this embodiment, service life management is performed by measuring a voltage of the conductive member. Out of the conductive members described above, the charging roller 8 will now be described representatively.

Figure 5:
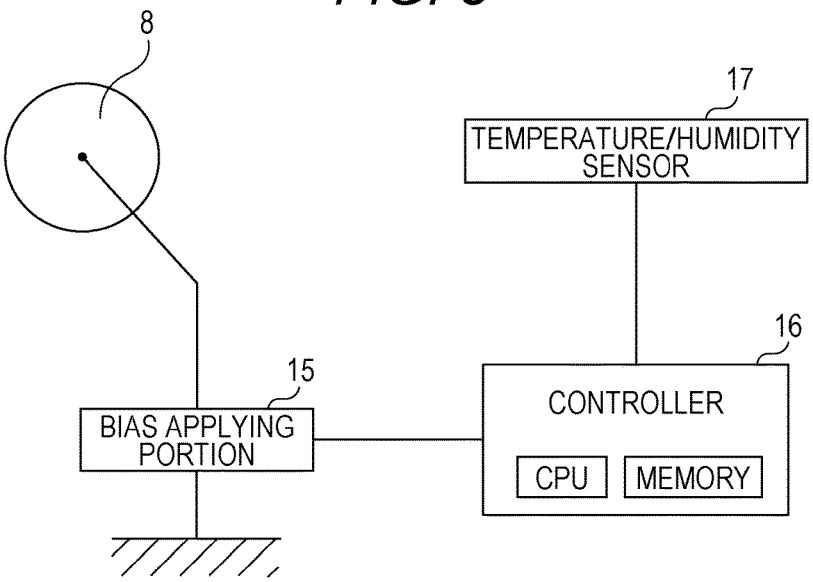
FIG. 5 is a block diagram illustrating a conductive member and a service life management mechanism according to an embodiment of the present invention.

The image forming apparatus 1 according to this embodiment has a configuration of FIG. 5 in order to manage the service life of the charging roller 8. As illustrated in FIG. 5, the charging roller 8 has a bias applying portion 15. The bias applying portion 15 is connected to a controller 16. The controller 16 is also connected to a temperature/humidity sensor 17 in addition to the bias applying portion 15. The controller 16 includes a central processing unit (CPU) and a memory. The memory stores a program executed by the CPU.

The bias applying portion 15 applies a bias to the charging roller 8 in typical image formation. However, according to this embodiment, a voltage of the charging roller 8 is measured for service life management of the charging roller 8 as well. Specifically, a bias is applied to allow a predetermined constant current to flow through the charging roller 8, and a voltage value of that timing is acquired as a biased voltage value. The biased voltage value acquired in this manner reflects an electric resistance of the charging roller 8 of that timing. As the electric resistance of the charging roller 8 increases by wear-out, the biased voltage value acquired by the bias applying portion 15 also increases. In addition, according to this embodiment, the constant current is set to several tens of microamperes (μA). This is nearly the same as the current flowing through the charging roller 8 in typical image formation.

The controller 16 controls the bias applied to the charging roller 8 from the bias applying portion 15. The controller 16 performs a bias control for service life management as well as the control for typical image formation. The bias control for service life management includes the following three operations. As a first operation, a constant current is applied to the charging roller 8, and a voltage at that timing is acquired as the biased voltage value. As a second operation, the biased voltage value is transformed to a virtual voltage value on the basis of an environment measurement value output from the temperature/humidity sensor 17. The transformation will be described below in more details. As a third operation, the virtual voltage value obtained through the transformation is compared with a predetermined critical value. If the virtual voltage value is equal to or higher than the critical value, it is determined that the charging roller 8 is abnormal.

Such a voltage for service life management is measured while no image formation is performed instead of typical image formation. Specifically, the voltage measurement may be performed immediately after power on of the image forming apparatus 1, immediately before power off, or periodically whenever a predetermined number of sheets are printed (several hundreds to several thousands of sheets). In addition, when this voltage is measured, the environment measurement value from the temperature/humidity sensor 17 at that timing is also input to the controller 16.

The transformation from the biased voltage value to the virtual voltage value in the controller 16 is performed on the basis of the following transformation formula.

virtual voltage value=biased voltage value×(first critical voltage value/second critical voltage value) Transformation formula:

Here, the first and second critical voltage values in the aforementioned transformation formula have the following meanings. Such values are defined in advance through experiments using a charging roller 8 of the same specification.

First critical voltage value: the biased voltage value appearing when the charging roller 8 encounters a wear-out limitation, and the environment condition has a predetermined standard condition.

Second critical voltage value: the biased voltage value appearing when the charging roller 8 encounters a wear-out limitation, and the environment condition has the same condition as that of the voltage measurement timing.

From the aforementioned description, it is recognized that the voltage measurement value is directly used as the virtual voltage value when the environment condition at the voltage measurement timing satisfies a predetermined standard condition. That is, this transformation is sufficient as long as it is performed only when the environment condition at the voltage measurement timing does not satisfy the standard condition. Here, the "predetermined standard condition" is, for example, a neutral-temperature neutral-humidity condition. Here, the neutral-temperature neutral-humidity condition is defined as a temperature of 15 to 25° C. and a relative humidity of 25 to 75%. This is the environment condition most frequently observed yearly in a usual installation place. In this case, if the environment condition at the voltage measurement timing is the high-temperature high-humidity condition, the coefficient of the aforementioned transformation formula (parenthesized portion) is greater than "1." This is because the voltage value is smaller as the environment condition is closer to the high-temperature high-humidity side as illustrated in FIG. 1. In contrast, if the environment condition at the voltage measurement timing is the low-temperature low-humidity condition, the coefficient is smaller than "1."

Figure 3:
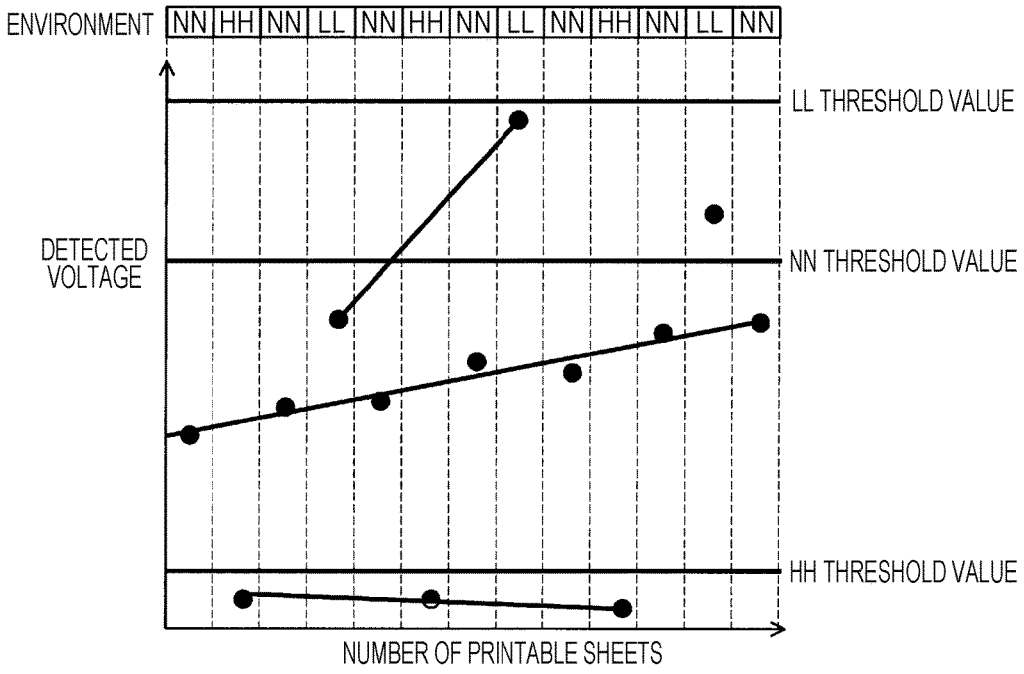
FIG. 3 is a graph illustrating a change of the detected voltage value under a real environment.
Figure 6:
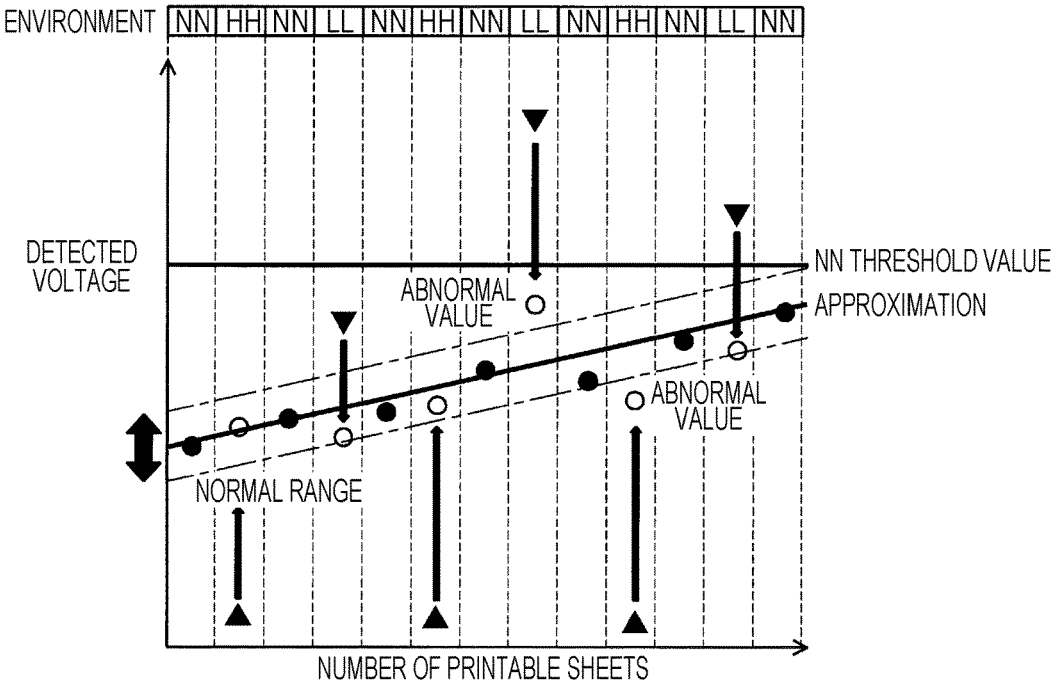
FIG. 6 is a graph illustrating a change of the virtual voltage value obtained by transforming the detected voltage value under a real environment.

If the virtual voltage values obtained in this manner whenever the voltage is measured are plotted along the number of printable sheets, for example, the graph of FIG. 6 is obtained. In FIG. 6, the biased voltage values resulting from the measurement (indicated by black circles in the drawing) are similar to the black circles of FIG. 3. However, the measurement values acquired under the "LL" or "HH" environment are plotted as the virtual voltage values transformed on the basis of the transformation formula as described above (in the drawings, white circles). That is, the value obtained under the "LL" environment is transformed downward due to the coefficient smaller than "1." Meanwhile, the value obtained under the "HH" environment is transformed upward due to the coefficient larger than "1." Note that the value obtained under the "NN" environment is not significantly changed around the transformation, and thus, only black circles are plotted.

Figure 2:
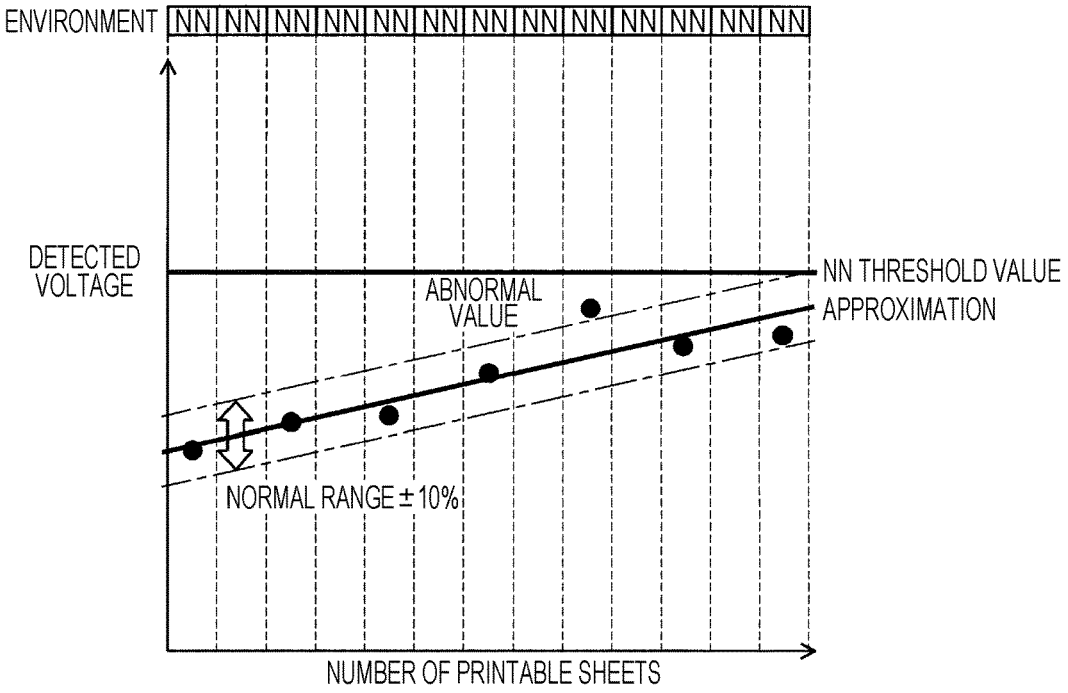
FIG. 2 is a graph illustrating a change of the detected voltage value under a neutral-temperature neutral-humidity environment.

Referring to the plots obtained by the transformation in FIG. 6 (black circles under the "NN" condition and white circles under the "LL" or "HH" condition), they satisfy a normal range of ±10% for an approximation. Although several white circles that do not satisfy the normal range exist, they are still within an allowable range. As a whole, they are not significantly deviated from the plots of FIG. 2. Therefore, in this case, by comparing the virtual voltage value subjected to the transformation with a critical value determined for the neutral-temperature neutral-humidity condition ("NN threshold value" in FIG. 6) in advance, it is possible to appropriately determine the service life of the charging roller 8. For this reason, it is desirable to set the critical voltage values for each environment condition and the critical value of the neutral-temperature neutral-humidity condition in the controller 16 in advance.

Here, the critical value under the neutral-temperature neutral-humidity condition may be equal to the first critical voltage value described above or may be a value determined in advance around the first critical voltage value (within a range of ±10%). If the critical value is set to be smaller than the first critical voltage value, the charging roller 8 can be replaced slightly earlier with safety. If the critical value is set to be larger than the first critical voltage value, replacement of the charging roller 8 is delayed. This is acceptable in the case of the image forming apparatus 1 used for applications not requiring excellent image quality.

The predetermined standard condition is the neutral-temperature neutral-humidity condition in the aforementioned description, but this is not indispensable. For example, in some places where the image forming apparatus 1 is used, the environment condition other than the neutral-temperature neutral-humidity condition may appear most frequently. In the case of the image forming apparatus 1 delivered to such a place of use, it is desirable to set the environment condition as a predetermined standard condition. In this case, the critical value of the environment condition set as the standard condition is set in the controller 16 in advance.

Alternatively, an environment condition appearing most frequently at the voltage measurement timing may be set as the standard condition. For this purpose, it is necessary to store a history of the environment condition acquired at the voltage measurement timing in the controller 16 and provide a function of determining the environment condition appearing most frequently out of the history. In addition, critical values for each environment condition that may be used as the predetermined standard condition are determined in advance. In particular, in this case, it is desirable to restrict the history of the stored environment conditions to those acquired within a predetermined time length of the immediate past. As a result, it is possible to automatically follow a change of the most frequent environment condition depending on a season change.

Which environment condition will be set as the standard condition may be selected by a user. For this purpose, it is necessary to provide the controller 16 with a function of allowing a user to select the environment condition used as the standard condition and a function of using the selected environment condition as the standard condition subsequently. In addition, the critical values for each environment condition that may be selected as the predetermined standard condition are set in advance. As a result, it is possible to modify the selection of the standard condition depending on a climate at that timing such as when a service staff visits. Alternatively, the selection of the standard condition may be modified by a remote control from a service center by connecting the image forming apparatus 1 to a network or the like. In addition, by consolidating the history of the biased voltage values or the environment condition values into the service center, it is possible to create a visiting plan of the service staff or use it for development of the next model.

Hereinbefore, the first and second critical voltage values for the transformation formula described above have been described in brief by narrowing the environment conditions to three conditions including the high-temperature high-humidity condition, the neutral-temperature neutral-humidity condition, and the low-temperature low-humidity condition. However, the first and second critical voltage values may be set more accurately.

Figure 7:
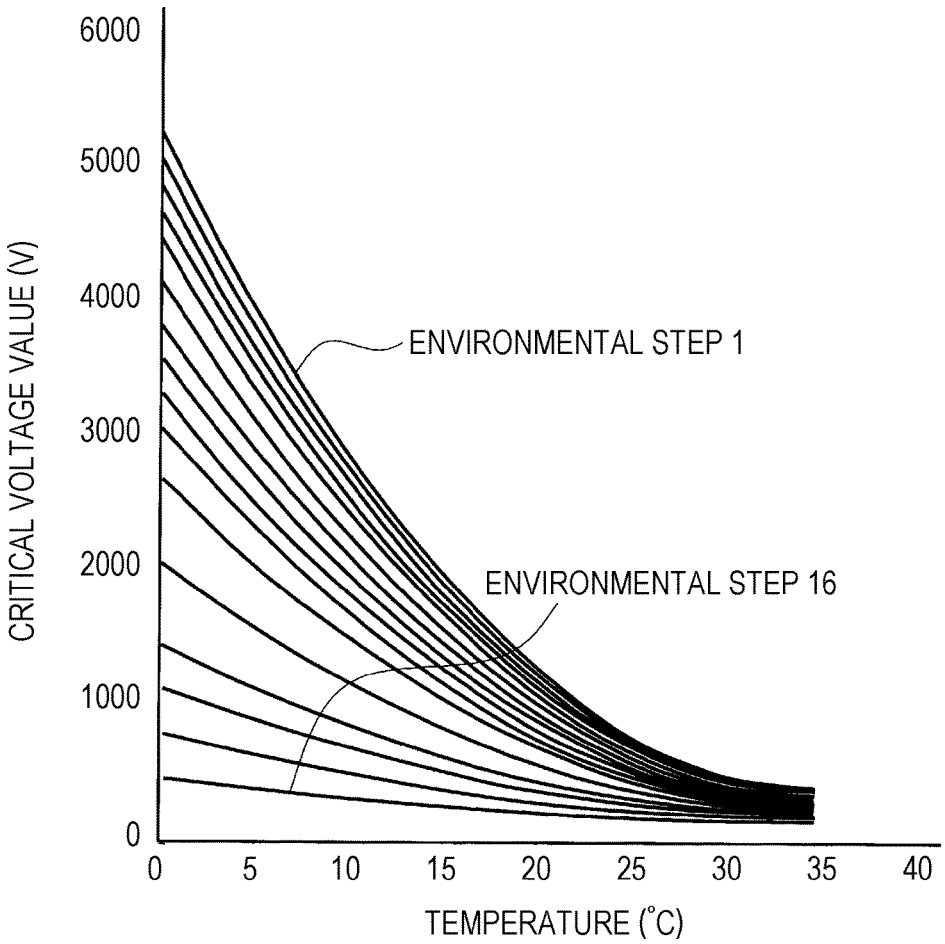
FIG. 7 is a graph illustrating critical voltage values specified for each environment.

For this purpose, the graph of FIG. 7 is used. In the graph of FIG. 7, the ordinate refers to a temperature of the environment condition to show a relationship between the temperature and the critical voltage. FIG. 7 contains sixteen curves. These sixteen curves are obtained by dividing the environment conditions into sixteen stages on the basis of the absolute humidity of the environment condition (they can be computed from the temperature and the relative humidity using the temperature/humidity sensor 17). That is, FIG. 7 shows a relationship between the temperature and the critical voltage for each absolute humidity. Out of sixteen curves of FIG. 7, the highest position corresponds to the lowest absolute humidity (environmental step 1) of sixteen stages, and the lowest position corresponds to the highest absolute humidity (environmental step 16).

All of the sixteen curves are common to those of the graph of FIG. 1 in the following facts. That is, the voltage value is lower, and the slope is gentle as close to the right side (high temperature side) in the graph. In addition, the voltage value is lower, and the slope is steep as close to the left side (low temperature side) in the graph. In this regard, these sixteen curves are approximated to a quadratic curve. Specifically, the critical voltage value is expressed as the following quadratic formula by setting the temperature t as a variable.

$$\text{critical voltage value}=at^2+bt+c$$

Here, the coefficient a of the second order term is set to be positive. That is, since the graph of the quadratic formula is an upward opening parabolic curve, the sixteen curves of FIG. 7 are on the left side with respect to a vertex of the parabolic curve. Each coefficient of the quadratic formula was set as illustrated in the table of FIG. 8 by mapping based on experimental results obtained by placing the charging roller 8 having the same specification as the actual one under various conditions. The numerals 1 to 16 immediately in the right side of the "environmental step" in FIG. 8 correspond to the sixteen curves of FIG. 7 in order from the top. Here, the environmental step 2 corresponding to the second lowest humidity stage is almost at the center of the environment condition usually referred to as the "LL" environment. In addition, the environmental step 10 is almost at the center of the environment condition usually referred to as the "NN" environment. In addition, the environmental step 15 corresponding to the second highest humidity is almost at the center of the environment condition usually referred to as the "HH" environment.

The numerical values in the columns "a," "b," and "c" in FIG. 8 correspond to the coefficients of the second order term, the first order term, and the constant term, respectively, of the quadratic formula. Referring to the numerical value of the column "a," the higher value is obtained from the upper row, the smaller value is obtained the lower row. This matches characteristics of the shapes of the sixteen curves in the graph of FIG. 7. In addition, referring to the numerical value of the column "c" in FIG. 8, similarly, the larger value is obtained from the upper row, and the smaller value is obtained from the lower row. Since the numerical value of the column "c" corresponds to the y-intercept of each curve in the graph of FIG. 7, this also matches the actual y-intercept of each curve.

In this regard, at the voltage measurement timing, the first and second voltage values described above are determined using the graph of FIG. 7. First, for the first critical voltage value, the absolute humidity is obtained on the basis of the temperature value and the relative humidity of the environment condition as the standard condition. Which curve of FIG. 7 is used is determined on the basis of the obtained absolute humidity. If the curve is determined, the critical voltage value may be read from the temperature value of the environment condition and its curve. This corresponds to the first critical voltage value. For the second critical voltage value, similar operation may be performed depending on the temperature and humidity values obtained from the temperature/humidity sensor 17 at the voltage measurement timing. This corresponds to the second critical voltage value. Using the first and second critical voltage values obtained in this manner, the virtual voltage values are obtained on the basis of the aforementioned transformation formula, so that it is possible to perform more accurate service life management. For this reason, the graph of FIG. 7 based on the experiment result and the step division based on the absolute humidity for that purpose may be stored in the controller 16 in advance.

In the aforementioned description, the number of division based on the absolute humidity is not limited to sixteen. That is, the number of curves of FIG. 7 may not be sixteen. In addition, the approximation of the curve is not limited to the quadratic formula. A linear formula may also be sufficient depending on a material of the charging roller 8 in some cases. Furthermore, a table method may also be used regardless of a special numerical formula. An optimum method may be selected on the basis of the experimental results. As a result, it is possible to more accurately manage the service life by plotting the transformed virtual voltage values as illustrated in FIG. 6.

Figure 9:
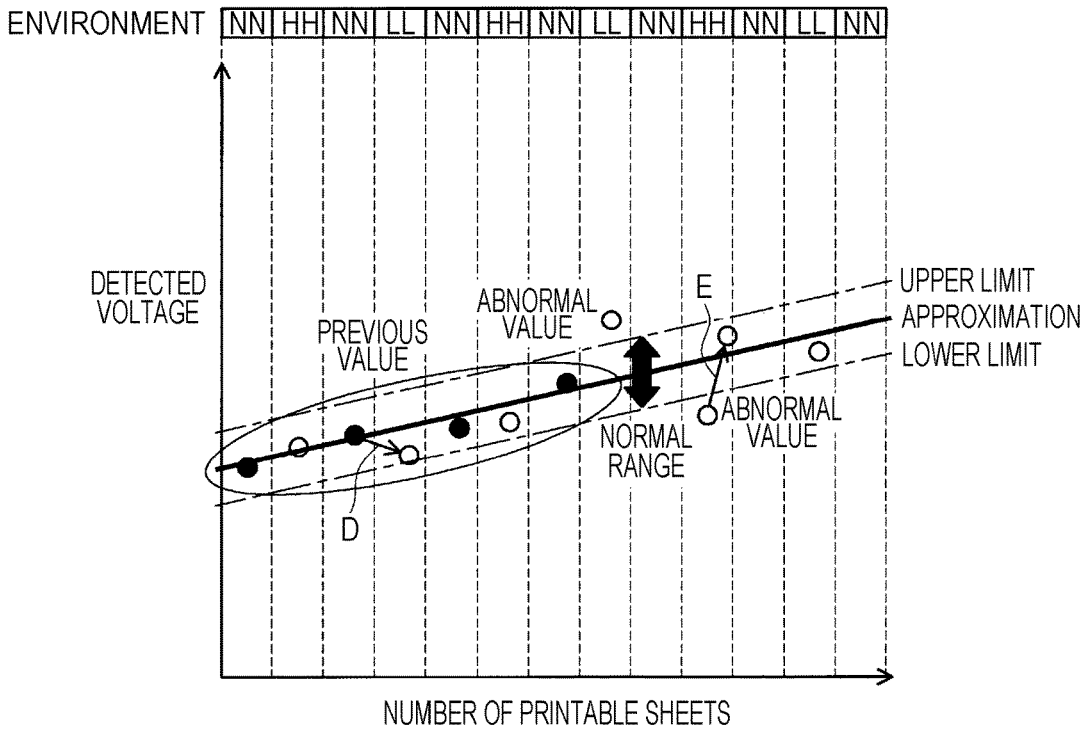
FIG. 9 is a graph illustrating a method of determining abnormality in a plot of the virtual voltage value.

In FIG. 6, an approximation was applied to the plots of the virtual voltage values, and a normal range for this approximation was set to ±10%. Then, the approximation may be obtained again by excluding those deviated from the normal range from the virtual voltage values transformed from the biased voltage values of the "LL" or "HH" environment. As a result, it is possible to further improve the accuracy. In addition, as indicated by the arrow D in the graph of FIG. 9, the virtual voltage value may be lower than the previous one even when the number of printable sheets is reduced in some cases. This case may be determined as abnormality even when it is within the established normal range. This similarly applies to the case where the virtual voltage value excessively rises from the previous one (arrow E) on the contrary. That is, a range of the next virtual voltage value may be determined in advance with respect to the previous virtual voltage value, and the case where the next virtual voltage value is deviated from this range actually may be determined as abnormality.

If abnormality occurs more frequently, the abnormality may be warned on a display panel of the image forming apparatus 1 or may be notified to the service center. This is because the charging roller 8 may suffer from pressing point separation or abnormality in high pressure output. In addition, the abnormality may be similarly warned or notified when it occurs from a new product or a nearly new product. This is because the charging roller 8 may be a defective part.

In the aforementioned description, whether or not the service life of the charging roller 8 has come is determined by measuring the voltage. However, in the image forming apparatus 1 according to this embodiment, the wear rate may be computed for the charging roller 8 whose service life has not yet come by measuring the voltage as well. The wear rate refers to a percentage of the consumed part against the entire service life and is set to 0% for a new product and 100% for the product whose service life has come.

This wear rate is computed on the basis of the following formula using the virtual voltage values transformed as described above.

wear rate=(virtual voltage value−initial standard voltage value)/(first critical voltage value−initial standard voltage value)

The resulting value is multiplied by 100 for conversion into a percentage notation. Here, the initial standard voltage value is a biased voltage value for a new charging roller 8 under the standard condition.

By computing the wear rate in this manner, it is possible to notice a user of the end of the service life in advance. As a result, a user can prepare a new product for replacement before the charging roller 8 becomes completely failed.

Various service life management methods described above according to this embodiment are particularly important when the charging roller 8 is formed of an ionic conductive material (such as epichlorohydrin rubber or urethane). This is because the ionic conductive material is characterized in that voltage detection accuracy is worse under the low-temperature low-humidity or high-temperature high-humidity condition, compared to other conductive materials. In the aforementioned embodiment, the charging roller 8 has been described by way of example out of the secondary transfer roller 6, the charging roller 8, the primary transfer roller 11, and the developing roller 13 of the image forming apparatus 1. Various service life management methods described above may also be applied to the secondary transfer roller 6, the primary transfer roller 11, and the developing roller 13. Such cases are also included in the scope of the present invention as long as the service life management described above is applied to any one of the four applications.

As described above in details, using the image forming apparatus 1 according to this embodiment, the virtual voltage value measured whenever a voltage is measured for detecting the service life of the conductive member (such as the charging roller 8) is transformed depending on the environment condition to obtain the virtual voltage value. In addition, the service life is determined on the basis of this virtual voltage value. For this reason, the service life is determined without using a large error region in the relationship between the environment condition and the voltage value. As a result, it is possible to implement an image forming apparatus capable of detecting the service life of the conductive member with high accuracy regardless of any environmental factor. In addition, it is possible to implement a conductive member service life determination method for the image forming apparatus and a conductive member service life determination program executed by a computer for controlling the image forming apparatus.

Figure 4:
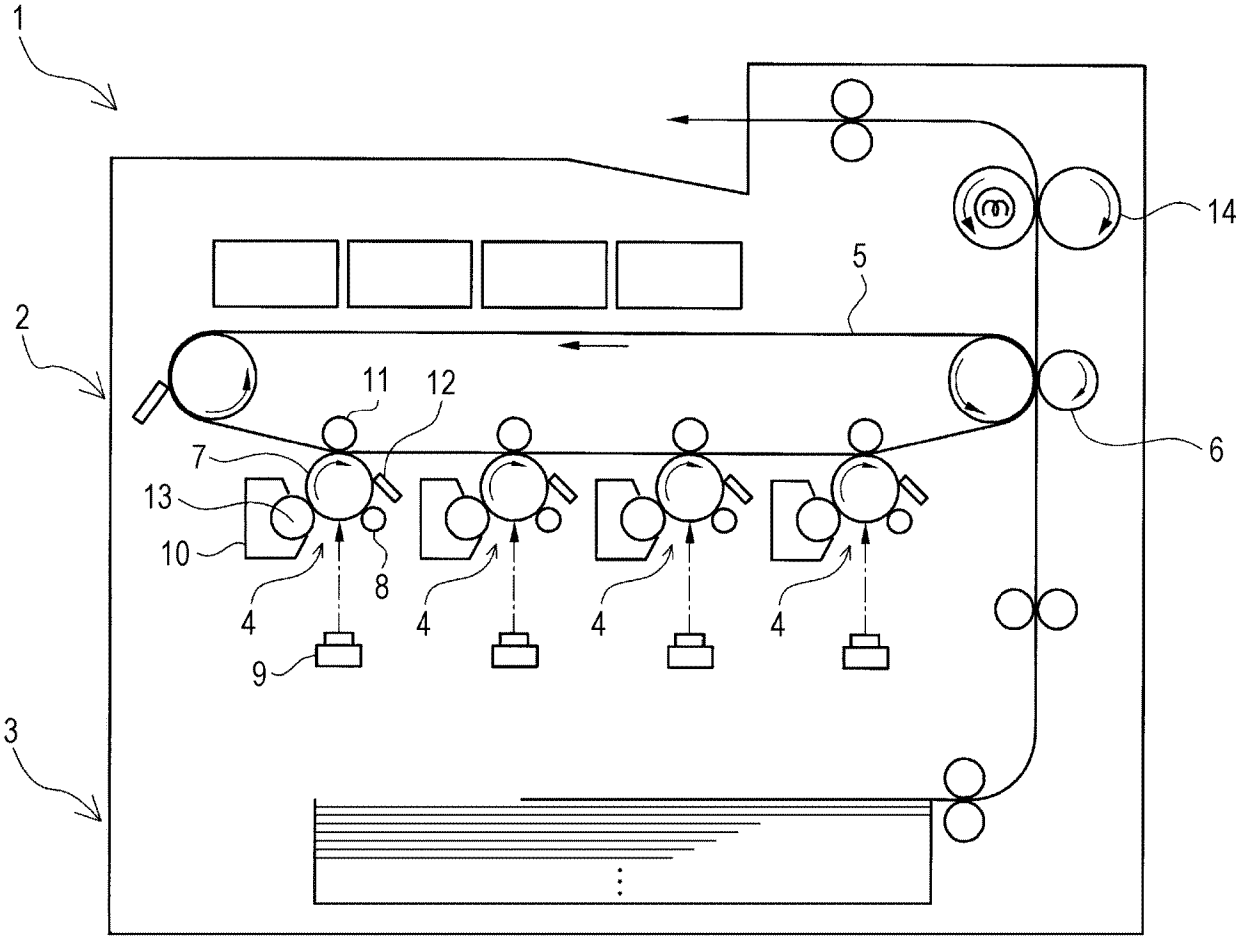
FIG. 4 is a cross-sectional view illustrating a whole structure of an image forming apparatus according to an embodiment of the present invention.

Note that the embodiments of the present invention are just for exemplary purposes, and are not intended to limit the scope of the invention. Naturally, various modifications or alterations may be possible without departing from the spirit and scope of the invention. For example, although the image forming apparatus 1 of FIG. 4 is a tandem type, a multi-cycle type or a monochromatic type may also be employed without any limitation. Any type of developer may also be employed in the developer 10. In addition, the image forming apparatus 1 may also have a reader function, a communication function, a both-side sheet processing function, or a post-processing function.

In the image forming apparatus according to the aforementioned aspect, the voltage acquisition portion acquires a voltage value appearing when a bias is applied to the conductive member in order to detect a service life of the conductive member. This voltage value is called a biased voltage value. This biased voltage value is transformed into a voltage value appearing under the standard environment condition on the basis of the environment condition measurement value output from the environment sensor. This voltage value is called a virtual voltage value. Using this virtual voltage value, the service life determining portion determines the service life. As a result, the service life is determined using a high accuracy region without using an error region.

In the image forming apparatus according to the aforementioned aspect, the hardware processor preferably uses, as the standard environment condition, the most frequent environment condition in a history of the environment condition measurement value when the biased voltage value is acquired. As a result, the biased voltage value can be directly transformed into the virtual voltage value in many cases. For this reason, it is possible to more accurately determine the service life.

In the image forming apparatus according to the aforementioned aspect, the hardware processor preferably allows a user to select the environment condition used as the standard environment condition and uses the selected environment condition as the standard environment condition subsequently. In this way, a user or a service crew is allowed to select the environment condition used as the standard environment condition, and this contributes to convenience.

In the image forming apparatus according to any of the aforementioned aspects, the biased voltage value is preferably a voltage value for applying a constant current to the conductive member. It is conceived that the biased voltage value obtained in this manner reflects a wear-out status of the conductive member.

In the image forming apparatus according to any of the aforementioned aspects, the hardware processor preferably acquires a first critical voltage value appearing when the conductive member reaches a wear-out limitation under the standard environment condition, and a second critical voltage value appearing when the conductive member reaches the wear-out limitation under an environment condition corresponding to the environment condition measurement value output from the environment sensor, acquires the virtual voltage value by applying a coefficient obtained by dividing the first critical voltage value by the second critical voltage value to the biased voltage value acquired by the voltage acquisition portion, and determines that abnormality occurs when the virtual voltage value is equal to or larger than a predetermined critical value. In this way, it is possible to appropriately compute the virtual voltage value and determine the service life with high accuracy.

In the image forming apparatus according to the aforementioned aspect, the hardware processor preferably sets a range of the next virtual voltage value when the virtual voltage value is obtained, and determines that abnormality occurs when the next virtual voltage value obtained actually is within the range. As a result, abnormality determination is also performed on the basis of a relationship between the virtual voltage value measured in the past and the current virtual voltage value.

In the image forming apparatus according to any of the aforementioned aspects, the hardware processor preferably computes a wear rate as a proportion of a consumed part of the service life against the entire service life of the conductive member by dividing a difference obtained by subtracting, from the virtual voltage value, an initial standard voltage value as a voltage value appearing as the biased voltage value under the standard environment condition when the conductive member is a new product, by a difference obtained by subtracting the initial standard voltage value from the first critical voltage value. In this way, it is possible to predict termination of the service life in advance as well as simple abnormality determination, and this contributes to convenience.

In the image forming apparatus according to any of the aforementioned aspects, the hardware processor preferably stores a relationship between a temperature and a critical voltage value for each absolute humidity based on the environment condition, and reads the first and second critical voltage values from a relationship between a temperature and a critical voltage value for each absolute humidity on the basis of a standard environment condition and an environment condition corresponding to the environment condition measurement value output from the environment sensor. In this way, it is possible to classify the environment condition case by case in more details and highly accurately determine the service life through optimum transformation for the corresponding case.

In the image forming apparatus according to any of the aforementioned aspects, the conductive member is preferably formed of an ionic conductive material. An ionic conductive material tends to more easily exhibit degradation of voltage detection accuracy under a low-temperature low-humidity condition and a high-temperature high-humidity condition, compared to other conducting materials. Therefore, as described above, highly accurate abnormality determination is important in some cases.

In the image forming apparatus according to any of the aforementioned aspects, the hardware processor preferably uses an environment condition including a temperature of 15 to 25° C. and a relative humidity of 25 to 75% as the standard environment condition. Such an environment condition highly frequently appears in practice, and the biased voltage value can be directly used as the virtual voltage value in many cases. For this reason, it is possible to perform more accurate determination.

According to another aspect of the present invention, there is provided a conductive member service life determination method executed in an image forming apparatus provided with a conductive member to form an image on a sheet using a toner, the conductive member service life determination method comprising: a voltage acquisition step of acquiring a biased voltage value as a voltage value obtained by applying a bias to the conductive member; an environment acquisition step of acquiring an environment condition measurement value representing an internal environment condition; a step of transforming the biased voltage value acquired in the voltage acquisition step into a virtual voltage value indicated by the conductive member as the biased voltage value under the standard environment condition in which the environment condition has a predetermined standard condition on the basis of the environment condition measurement value acquired in the environment acquisition step; and a step of determining a service life of the conductive member on the basis of the virtual voltage value.

According to yet another aspect of the present invention, there is provided a non-transitory computer-readable storage medium that stores a program for causing a computer to execute the conductive member service life determination method described above.

In the non-transitory computer-readable storage medium according to the aforementioned aspect, in the step of determining a service life, the most frequent environment condition in a history of the environment condition measurement value at the time of acquisition of the biased voltage value is preferably used as the standard environment condition.

In the non-transitory computer-readable storage medium according to the aforementioned aspect, in the step of determining a service life, a user is preferably allowed to select an environment condition used as the standard environment condition, and the selected environment condition is preferably used as the standard environment condition subsequently.

In the non-transitory computer-readable storage medium according to the aforementioned aspect, the biased voltage value is preferably a voltage value for applying a constant current to the conductive member.

In the non-transitory computer-readable storage medium according to the aforementioned aspect, the step of determining a service life preferably includes the steps of: acquiring a first critical voltage value appearing in a wear-out limitation of the conductive member under a standard environment condition and a second critical voltage value appearing in a wear-out limitation of the conductive member under an environment condition corresponding to the environment condition measurement value output from the environment sensor; acquiring a virtual voltage value by applying a coefficient obtained by dividing the first critical voltage value by the second critical voltage value to the biased voltage value acquired by the voltage acquisition portion; and determining that abnormality occurs when the virtual voltage value is equal to or higher than a predetermined critical value.

In the non-transitory computer-readable storage medium according to the aforementioned aspect, in the step of determining a service life, a range of the next virtual voltage value is preferably set when the virtual voltage value is obtained, and it is preferably determined that abnormality occurs when the next virtual voltage value obtained actually is within the range.

In the non-transitory computer-readable storage medium according to the aforementioned aspect, the step of determining a service life preferably further includes a step of computing a wear rate as a proportion of a consumed part with respect to the entire service life of the conductive member by dividing a difference obtained by subtracting, from the virtual voltage value, an initial standard voltage value which is a voltage value appearing in a new product of the conductive member as the biased voltage value under the standard environment condition by a difference obtained by subtracting the initial standard voltage value from the first critical voltage value.

In the non-transitory computer-readable storage medium according to the aforementioned aspect, the step of determining a service life preferably further includes the steps of: storing a relationship between a temperature and a critical voltage value for each absolute humidity based on an environment condition; and reading the first and second critical voltage values from the relationship between the temperature and the critical voltage value for each absolute humidity on the basis of the standard environment condition and the environment condition corresponding to the environment condition measurement value output from the environment sensor.

In the non-transitory computer-readable storage medium according to the aforementioned aspect, the conductive member is preferably formed of an ionic conductive material.

In the non-transitory computer-readable storage medium according to the aforementioned aspect, in the step of determining a service life, an environment condition having a temperature of 15 to 25° C. and a relative humidity of 25 to 75% is preferably used as the standard environment condition.

According to an embodiment of the present invention, there is provided an image forming apparatus capable of detecting the service life of the conductive member with high accuracy regardless of an environmental factor. In addition, there are also provided a conductive member service life determination method for the image forming apparatus and a conductive member service life determination program executed by a computer that controls the image forming apparatus.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming apparatus provided with a conductive member to form an image on a sheet using a toner, the image forming apparatus comprising:

a voltage acquisition portion acquiring a biased voltage value as a voltage value by applying a bias to the conductive member;

an environment sensor outputting an environment condition measurement value representing an internal environment condition; and a hardware processor transforming the biased voltage value acquired by the voltage acquisition portion into a virtual voltage value appearing in the conductive member as the biased voltage value under a standard environment condition, in which the environment condition has a predetermined standard condition, on the basis of the environment condition measurement value output from the environment sensor, and determining a service life of the conductive member on the basis of the virtual voltage value.

2. The image forming apparatus according to claim 1, wherein the hardware processor uses, as the standard environment condition, a frequent environment condition in a history of the environment condition measurement value when the biased voltage value is acquired.

3. The image forming apparatus according to claim 1, wherein the hardware processor allows a user to select the environment condition used as the standard environment condition and uses the selected environment condition as the standard environment condition subsequently.

4. The image forming apparatus according to claim 1, wherein the biased voltage value is a voltage value for applying a constant current to the conductive member.

5. The image forming apparatus according to claim 1, wherein the hardware processor acquires a first critical voltage value appearing when the conductive member reaches a wear-out limitation under the standard environment condition, and a second critical voltage value appearing when the conductive member reaches the wear-out limitation under an environment condition corresponding to the environment condition measurement value output from the environment sensor, acquires the virtual voltage value by applying a coefficient obtained by dividing the first critical voltage value by the second critical voltage value to the biased voltage value acquired by the voltage acquisition portion, and determines that abnormality occurs when the virtual voltage value is equal to or larger than a predetermined critical value.

6. The image forming apparatus according to claim 5, wherein the hardware processor sets a range of the next virtual voltage value when the virtual voltage value is obtained, and determines that abnormality occurs when the next virtual voltage value obtained actually is within the range.

7. The image forming apparatus according to claim 5, wherein the hardware processor computes a wear rate as a proportion of a consumed part of the service life against the entire service life of the conductive member by dividing a difference obtained by subtracting, from the virtual voltage value, an initial standard voltage value as a voltage value appearing as the biased voltage value under the standard environment condition when the conductive member is a new product, by a difference obtained by subtracting the initial standard voltage value from the first critical voltage value.

8. The image forming apparatus according to claim 5, wherein the hardware processor stores a relationship between a temperature and a critical voltage value for each absolute humidity based on the environment condition, and reads the first and second critical voltage values from a relationship between a temperature and a critical voltage value for each absolute humidity on the basis of a standard environment condition and an environment condition corresponding to the environment condition measurement value output from the environment sensor.

9. The image forming apparatus according to claim 1, wherein the conductive member is formed of an ionic conductive material.

10. The image forming apparatus according to claim 1, wherein the hardware processor uses an environment condition including a temperature of 15 to 25° C. and a relative humidity of 25 to 75% as the standard environment condition.

11. A conductive member service life determination method executed in an image forming apparatus provided with a conductive member to form an image on a sheet using a toner, the conductive member service life determination method comprising:

a voltage acquisition step of acquiring a biased voltage value as a voltage value obtained by applying a bias to the conductive member;

an environment acquisition step of acquiring an environment condition measurement value representing an internal environment condition;

a step of transforming the biased voltage value acquired in the voltage acquisition step into a virtual voltage value indicated by the conductive member as the biased voltage value under a standard environment condition in which the environment condition has a predetermined standard condition on the basis of the environment condition measurement value acquired in the environment acquisition step; and a step of determining a service life of the conductive member on the basis of the virtual voltage value.

12. A non-transitory computer-readable storage medium that stores a program for causing a computer to execute the conductive member service life determination method according to claim 11.

13. The non-transitory computer-readable storage medium according to claim 12, wherein, in the step of determining a service life, the most frequent environment condition in a history of the environment condition measurement value at the time of acquisition of the biased voltage value is used as the standard environment condition.

14. The non-transitory computer-readable storage medium according to claim 12, wherein, in the step of determining a service life, a user is allowed to select an environment condition used as the standard environment condition, and the selected environment condition is used as the standard environment condition subsequently.

15. The non-transitory computer-readable storage medium according to claim 12, wherein the biased voltage value is a voltage value for applying a constant current to the conductive member.

16. The non-transitory computer-readable storage medium according to claim 12, wherein the step of determining a service life includes the steps of:

acquiring a first critical voltage value appearing in a wear-out limitation of the conductive member under a standard environment condition and a second critical voltage value appearing in a wear-out limitation of the conductive member under an environment condition corresponding to the environment condition measurement value output from an environment sensor;

acquiring a virtual voltage value by applying a coefficient obtained by dividing the first critical voltage value by the second critical voltage value to the biased voltage value acquired during the voltage acquisition step; and determining that abnormality occurs when the virtual voltage value is equal to or higher than a predetermined critical value.

17. The non-transitory computer-readable storage medium according to claim 16, wherein, in the step of determining a service life, a range of the next virtual voltage value is set when the virtual voltage value is obtained, and it is determined that abnormality occurs when the next virtual voltage value obtained actually is within the range.

18. The non-transitory computer-readable storage medium according to claim 16, wherein the step of determining a service life further includes a step of computing a wear rate as a proportion of a consumed part with respect to the entire service life of the conductive member by dividing a difference obtained by subtracting, from the virtual voltage value, an initial standard voltage value which is a voltage value appearing in a new product of the conductive member as the biased voltage value under the standard environment condition by a difference obtained by subtracting the initial standard voltage value from the first critical voltage value.

19. The non-transitory computer-readable storage medium according to claim 16, wherein the step of determining a service life further includes the steps of:

storing a relationship between a temperature and a critical voltage value for each absolute humidity based on an environment condition; and reading the first and second critical voltage values from the relationship between the temperature and the critical voltage value for each absolute humidity on the basis of a standard environment condition and the environment condition corresponding to the environment condition measurement value output from the environment sensor.

20. The non-transitory computer-readable storage medium according to claim 12, wherein the conductive member is formed of an ionic conductive material.

21. The non-transitory computer-readable storage medium according to claim 12, wherein, in the step of determining a service life, an environment condition having a temperature of 15 to 25° C. and a relative humidity of 25 to 75% is used as the standard environment condition.

* * * * *